US005758623A

United States Patent [19]

Nitta et al.

[11] Patent Number: 5,758,623

[45] Date of Patent: Jun. 2, 1998

[54] FUEL INJECTION SYSTEM FOR INTERNAL COMBUSTION ENGINE

[75] Inventors: Yutaka Nitta, Hamamatsu; Shinji Kawamura, Shizuoka-Ken, both of Japan

[73] Assignee: Suzuki Kabushiki Kaisha, Japan

[21] Appl. No.: 604,247

[22] Filed: Feb. 21, 1996

[30] Foreign Application Priority Data

Feb. 28, 1995 [JP] Japan ..... 7-040822

[51] Int. Cl.[6] ..... F02M 37/04

[52] U.S. Cl. ..... 123/470; 123/337

[58] Field of Search ..... 123/337, 470, 123/585, 472

[56] References Cited

U.S. PATENT DOCUMENTS

| | | | |
|---|---|---|---|
| 3,620,195 | 11/1971 | Lamm | 123/337 |
| 4,158,352 | 6/1979 | Blatter | 123/337 |
| 4,276,862 | 7/1981 | Matsumoto . | |
| 4,363,302 | 12/1982 | Pischinger | 123/337 |
| 4,378,000 | 3/1983 | Moriya et al. . | |
| 4,513,720 | 4/1985 | Takeda | 123/470 |
| 4,726,341 | 2/1988 | Muranaka et al. . | |
| 4,768,486 | 9/1988 | Koike et al. . | |
| 4,829,966 | 5/1989 | D'Angelo et al. . | |
| 5,167,211 | 12/1992 | Fukuma et al. . | |
| 5,323,753 | 6/1994 | Cikanek | 123/337 |

FOREIGN PATENT DOCUMENTS

| | | | |
|---|---|---|---|
| 87 01 688 | 3/1987 | Germany . | |
| 0028038 | 2/1984 | Japan | 123/470 |
| 59-28038 | 6/1984 | Japan . | |
| 6010715 | 1/1994 | Japan | 123/337 |
| 6010803 | 1/1994 | Japan | 123/470 |
| 6173830 | 6/1994 | Japan | 123/337 |
| 4193474 | 7/1994 | Japan | 123/337 |
| 900 386 | 7/1962 | United Kingdom . | |
| 2 027 488 | 2/1980 | United Kingdom . | |

*Primary Examiner*—Carl S. Miller
*Attorney, Agent, or Firm*—Ronald P. Kananen

[57] ABSTRACT

A fuel injection system of an internal combustion engine of a vehicle such as motorcycle comprises a throttle body of a cylindrical structure having a passage for supplying a fuel-air mixture to a combustion chamber of an engine, a disc-shaped throttle valve disposed in the passage to be rotatable so as to regulate an amount of air flowing through the passage, and an injector means mounted on a peripheral wall of the passage and adapted to inject fuel in the passage at a portion of a downstream side of the throttle valve with respect to an air flow in the passage. The throttle valve is provided with a through hole opened to both surfaces of the throttle valve, and the through hole being formed at a portion on an injector location side with respect to a rotational axis of the throttle valve so that an axis of the through hole substantially accords with, or intersects, a central axis of a fuel injected from the injector when observed from the injector location side.

15 Claims, 4 Drawing Sheets

FUEL INJECTION SYSTEM FOR INTERNAL COMBUSTION ENGINE

BACKGROUND OF THE INVENTION

1. Field of the Invention

The present invention relates to a fuel injection system of an internal combustion engine which has a injector for injecting fuel.

2. Description of the Prior Art

A conventional fuel injection system used for an engine of a vehicle such as motorcycle is primarily constructed by an approximately cylindrical throttle body which has a passage for supplying a fuel-air mixture to a combustion chamber, an approximately disc-shaped throttle valve which is rotatably journaled to the peripheral wall of the passage and which regulates the amount of air flowing through the passage by the rotation of the throttle valve, and an injector which is mounted on the peripheral wall of the passage and which injects fuel to the passage through a nozzle at the distal end of the injector.

In this type of fuel injection system, the amount of air delivered from an air cleaner to the throttle body is regulated by the tilting angle of the throttle valve and fuel of a proper flow rate is injected through the nozzle at the distal end of the injector, thereby supplying the fuel-air mixture to the combustion chamber of the engine. The fuel is injected from the injector by, for example, forcibly feeding the fuel by a pump to the injector and then opening a solenoid valve, which is provided in the injector, for a limited time.

In the conventional fuel injecting system, the particle diameter of injected fuel is relatively large and a method for promoting the atomization of fuel, i.e. an air assist method, by providing small apertures around the nozzle, is sometimes adopted. According to this air assist method, however, the injecting angle becomes larger and fuel tends to adhere to the peripheral wall of the passage of the throttle body, possibly leading to an increased flow of the fuel along the peripheral wall or causing the fuel to stagnate in the throttle body. Therefore, the method does not necessarily ensure improvement in combustion. Especially at the time of idling, deceleration, or the like operation of a motorcycle when the opening degree of the throttle valve is small, it is likely that fuel fails to be fully atomized because of low flow rate and velocity.

SUMMARY OF THE INVENTION

A primary object of the present invention is to substantially eliminate defects or drawbacks encountered in the prior art and to provide a fuel injection system of an internal combustion engine capable of promoting the atomization of fuel to prevent the fuel from flowing along a wall surface of the passage or stagnating in a throttle body even under an idling condition or other conditions of the engine of a vehicle such as motorcycle, where the opening degree of the throttle valve is small, and also capable of effectively reducing residual hydrocarbon (HC) in an exhaust gas.

This and other objects can be achieved according to the present invention by providing a fuel injection system of an internal combustion engine comprising:

a throttle body of a cylindrical structure having a passage for supplying a fuel-air mixture to a combustion chamber of an engine;

a disc-shaped throttle valve disposed in the passage to be rotatable so as to regulate an amount of air flowing through the passage; and an injector means mounted on a peripheral wall of the passage and adapted to inject fuel in the passage at a portion downstream side of the throttle valve with respect to an air flow in the passage, wherein the throttle valve is provided with a through hole opened to both surface of the throttle valve, the through hole being formed at a portion on an injector location side with respect to a rotational axis of the throttle valve so that an axis of the through hole substantially accords with a central axis of a fuel injection from the injector when observed from the injector location side.

In preferred embodiments, the throttle valve is disposed in the passage in an inclined manner in a fully closed condition thereof that one end portion of the throttle valve on the injector location side is positioned on a downstream side of the rotational axis thereof and another end portion of the throttle valve is positioned on an upstream side of the rotational axis. These one and another end portions of the throttle valves have end faces obliquely cut so as to extend along an inner wall surface of the throttle body forming the passage.

The through hole is formed so as to extend vertically with respect to a thickness direction of the throttle valve.

Another injector means is mounted on the peripheral wall of the passage and adapted to inject fuel in the passage at a portion of an upstream side of the throttle valve with respect to an air flow in the passage.

According to the present invention of the structures and characters described above, in the throttle body, the air coming from the upstream side flows in a concentrated manner through the through hole and increases in its speed when the air passes through the throttle valve. Moreover, the through hole is disposed in the position where it nearly accords with the central axis in the injecting direction of the injector when observed from an injector location side with respect to the rotational axis of the throttle valve. Therefore, the air which has passed through the throttle valve and which has increased in flowing speed effectively collides with the fuel which has been injected from the injector at the downstream side of the throttle valve. This promotes the atomization of fuel and prevents the fuel from flowing along the wall surface or stagnating in the throttle body even at the small opening degree of the throttle valve and when the flow rate of the air is relatively low. Furthermore, the enhanced atomization reduces the residual hydrocarbon (HC) in the exhaust gas. This feature is marked at the time of idling or other operations of the engine where the opening degree of the throttle valve is small.

The nature and further features of the present invention will be made more clear through the following descriptions made with reference to the accompanying drawings.

DESCRIPTION OF THE PREFERRED EMBODIMENTS

The embodiments of the present invention will now be described with reference to the accompanying drawings.

Figure 1:
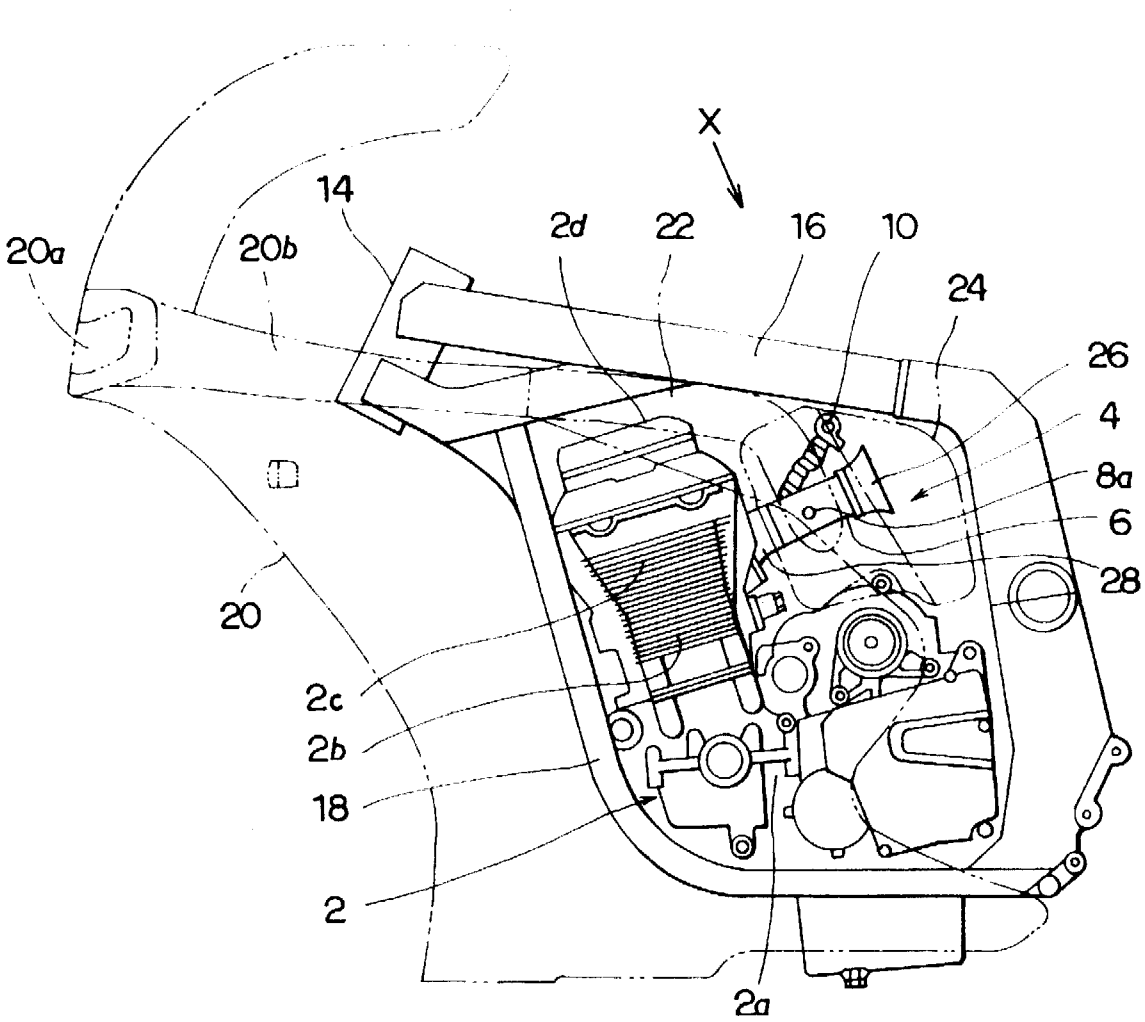
FIG. 1 is a side view of an engine according to an embodiment.
Figure 3:
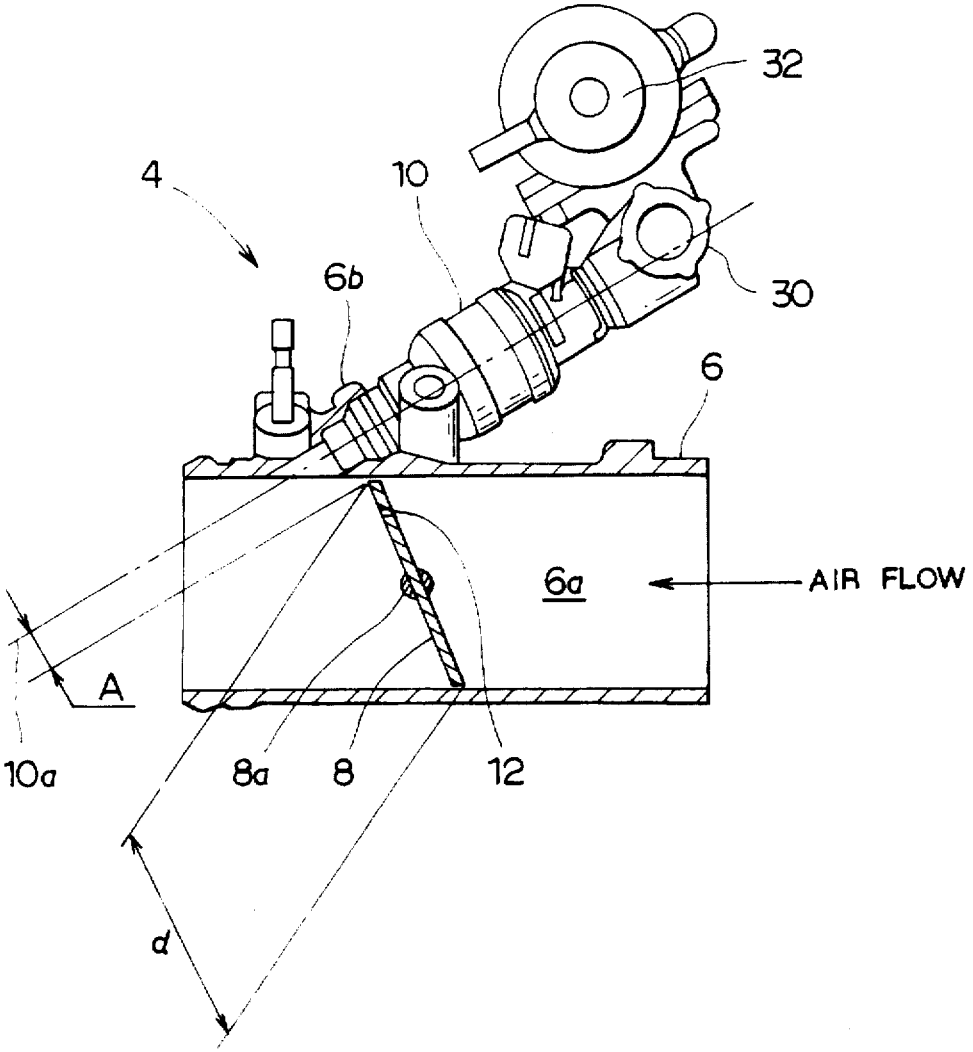
FIG. 3 is a cross-sectional view taken along the line III—III in FIG. 2 showing a throttle valve in a small opening degree.
Figure 4:
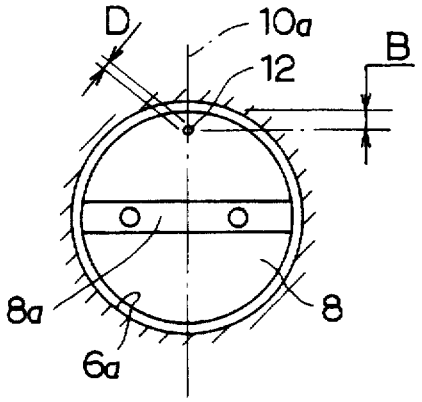
FIG. 4 is a rear view of the throttle valve in FIG. 3 as viewed from the upstream side.

FIGS. 1, 3 and 4 represent a first embodiment of a fuel injection system 4 of an engine 2 for a vehicle, preferably of a motorcycle. The engine is a low-pressure injection type having an approximately cylindrical throttle body 6 provided with a passage 6*a*for supplying a fuel-air mixture to a combustion chamber, an approximately disc-shaped throttle valve 8 which is rotatably journaled to the peripheral wall of the passage 6*a* and which regulates the amount of air flowing through the passage 6*a*by the rotation of the throttle valve 8, and an injector 10 mounted on the peripheral wall of the passage 6*a* and adapted to inject fuel to the passage 6*a*.

The injector 10 is disposed on the downstream side observed from the throttle valve 8, which is provided with a through hole 12 opened at both surfaces of the throttle valve 8.

The through hole 12 is disposed in a position at which the axis of the through hole 12 nearly accords with or intersects a central axis 10*a* of the injector 10 in the injecting direction thereof as viewed from the rear from the injector location side in relation to a rotational axis 8*a* of the throttle valve 8.

The structures of the respective elements or sections will be described hereunder in detail.

As shown in FIG. 1, the motorcycle according to the embodiment is equipped with a head pipe 14 which supports the front wheel capable of being steered, a main frame 16 extending rearward from the head pipe 14 and bent downward, and a down tube 18 extending downward from the head pipe 14 and connected to the bottom end of the main frame 16. The engine 2 is rested and fixed on the down tube 18. The motorcycle is also provided with a front cowl 20 which covers the front portion of the vehicle.

The engine 2 is of a parallel four-cylinder, four-stroke-cycle engine, and it is constituted mainly by a crank case 2*a* rotatably supporting a crankshaft, a cylinder 2*b* fastened to the front top surface of the crank case 2*a*, a cylinder head 2*c* fixed to the top end of the cylinder 2*b*, and a head cover 2*d*.

The front cowl 20 has an intake port 20*a* opened at the front portion thereof and a duct 20*b* formed integrally with the cowl 20 and extending from the intake port 20*a* in the longitudinal direction of the vehicle body. The duct 20*b* is connected to a front end of a hose 22 extending up to the rear top of the crank case 2*a*.

An air cleaner 24, into which air from the hose 22 is supplied, is disposed at the rear top of the crank case 2*a* and in the space formed at the rear of the cylinder 2*b* and the cylinder head 2*c*. The fuel injection system 4 is disposed in the vicinity of the side of the front section of the air cleaner 24. The throttle body 6, which constitutes the intake passage thereof, is connected to the intake passages of the air cleaner 24 and the cylinder head 2*c* via an outlet tube 26 and an intake pipe 28, respectively.

Figure 2:
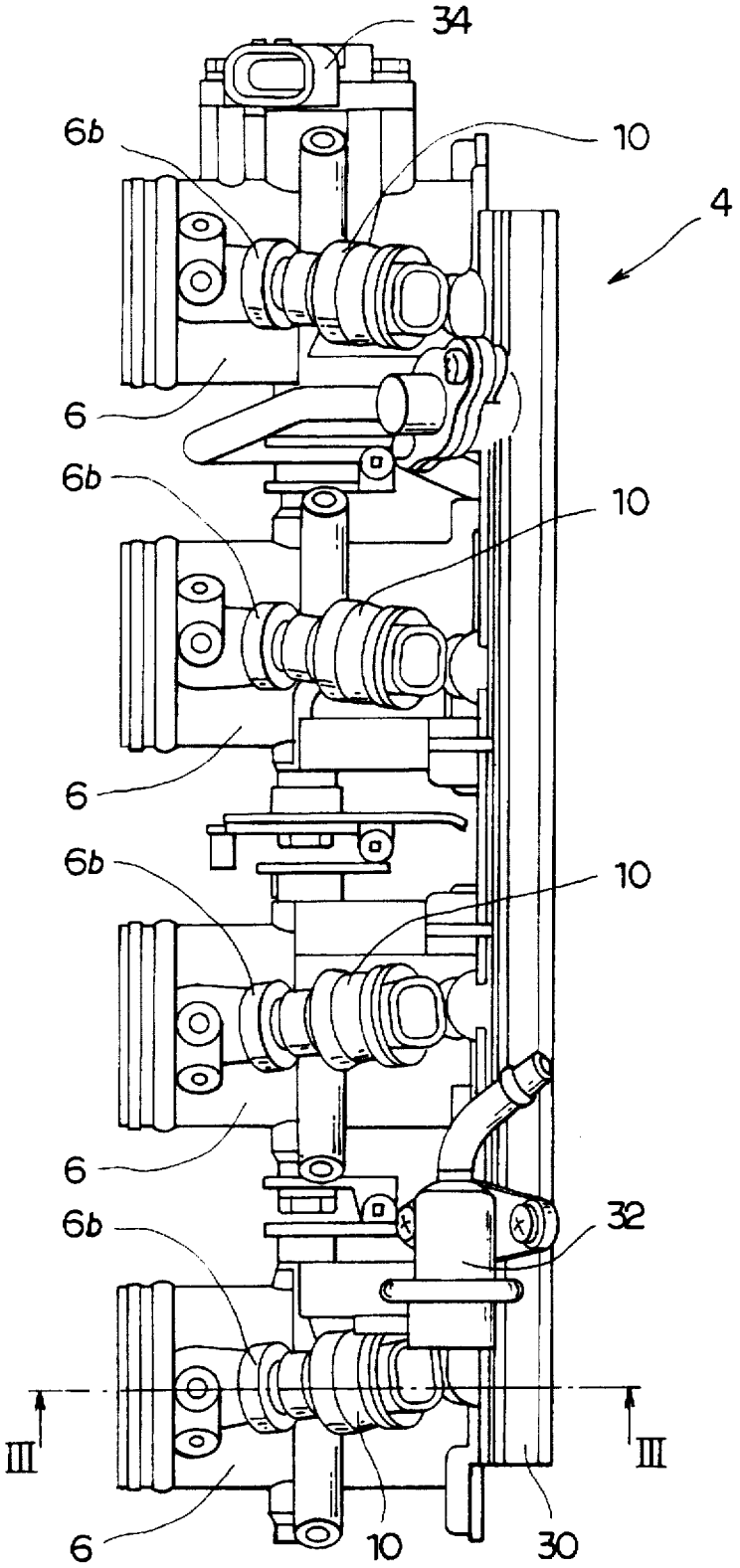
FIG. 2 is a top plan view of a fuel injection system viewed from direction X in FIG. 1.

In the fuel injection system 4, as shown in FIG. 2, the engine 2 has four cylinders each provided with the throttle body 6 and the injector 10. Provided behind the four injectors 10 is a delivery pipe 30 which supplies fuel to the respective injectors 10. Further, a regulator 32 for adjusting the pressure of fuel to be supplied to the injectors 10 is provided at the left edge (lower side as viewed) of the delivery pipe 30. A throttle position sensor 34 is provided beside the throttle body 6 disposed at the rightmost end (upper side as viewed).

An injector mounting section 6*b*, which opens toward a rear upward direction, is formed near the front portion of the upper wall of each throttle body 6 as shown in FIG. 3. Each injector 10 is mounted on the mounting section 6*b* in such a manner that the distal end thereof is fitted to the mounting section 6*b* so as to incline downward in a forward direction.

As illustrated in FIG. 3, the throttle valve 8, when it is fully closed, slightly tilts so that the top edge thereof is located on the downstream side as viewed from the rotational axis 8*a* of the throttle valve 8 with respect to the air flow in the passage and the bottom edge thereof is located on the upstream side. Accordingly, the top and bottom edges of the throttle valve 8 are cut obliquely along the inner wall surface of the throttle body 6 as viewed from the side.

The through hole 12 is formed to the throttle valve 8 to extend nearly vertically with respect to both surfaces, i.e. thickness direction, thereof at a position higher than the rotational axis 8a as shown in FIG. 3 when the opening degree of the throttle valve is small, and, as shown in FIG. 4, it approximately coincides with the central axis 10*a* of the injector 10 as observed from the back from the injector location side. It is desirable to set distance A (see FIG. 3) between the end surface of the throttle valve 8 on the injector 10 side and the central axis 10*a* of the injector 10 to 30 mm or less. Likewise, it is desirable to set distance B (see FIG. 4) between the end surface near the injector 10 in the throttle valve 8 and the through hole 12 to one quarter or less of the major diameter d of the valve. A suitable inside diameter D of the through hole 12 is considered to be 0.5 to 1.0 mm. The major diameter d of the valve refers to an outer diameter of the throttle valve 8 in the direction normal to the rotational axis 8*a*, and in this embodiment, it is the distance from the end of the top edge surface of the throttle valve 8 on the downstream side to the end of the bottom edge surface on the upstream side.

According to the embodiment having the structure described above, the fuel which has been forcibly supplied from a fuel tank to the pump is filtered through a filter and the pressure thereof is adjusted by the regulator 32 before it is delivered to the respective injectors 10 via the delivery pipe 30. Then, the fuel of the amount suitable for the characteristics of the engine is injected through the nozzles at the distal ends of the respective injectors 10 in accordance with the opening degree of the throttle valve 8 detected by the throttle position sensor 34 and the values detected through various sensors such as a water temperature sensor and an intake air temperature sensor.

In the throttle body 6, the air flowing from the upstream side converges to the through hole 12 in the throttle valve 8 and flows to the downstream side through the through hole with a velocity increased. At this time, the fast air flow effectively collides with the injected fuel even in the range, as illustrated in FIG. 3, where the opening degree of the throttle valve is small and the flow rate of the air is accordingly low.

Hence, the injected fuel promotes the atomization thereof through the collision, thus preventing the fuel from flowing along the wall surface or stagnating in the throttle body 6. In addition, the promoted atomization reduces the residual hydrocarbon in an exhaust gas, providing outstanding advantage especially at the time of idling or other conditions of the engine operation wherein the opening degree of the throttle valve is small.

Figure 5:
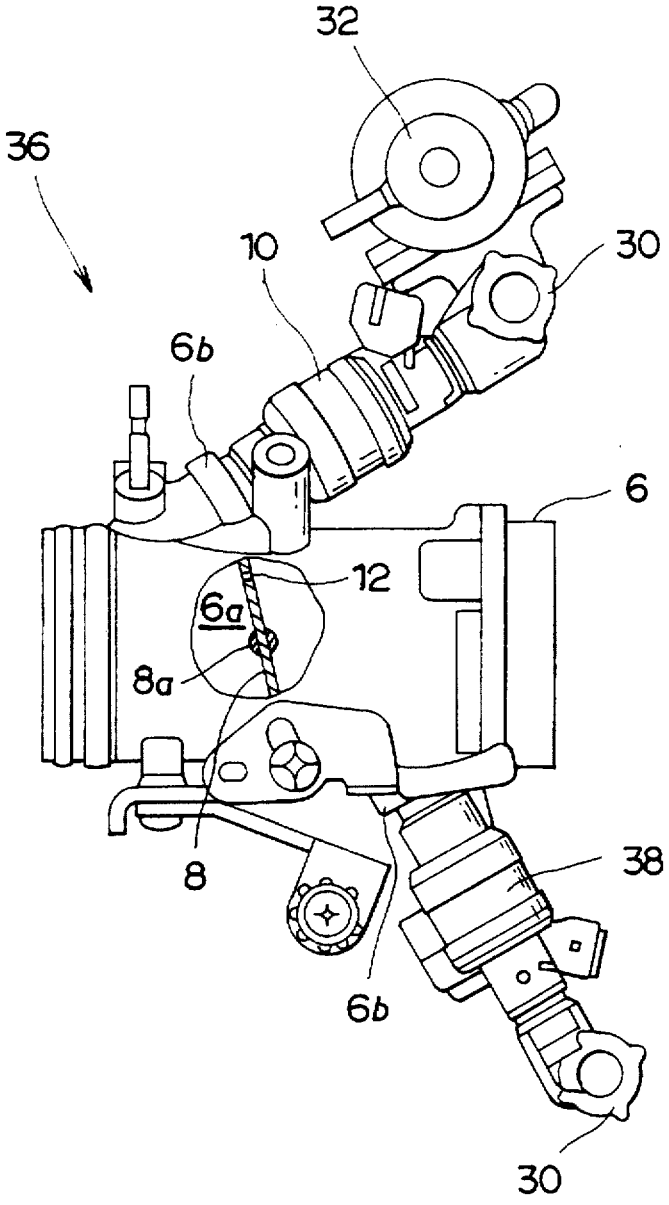
FIG. 5 is side view of a fuel injection system of another embodiment of the present invention.

This embodiment is a preferred embodiment of the present invention, but the technological range of the invention is not limited to this embodiment. For instance, although in the embodiment, the single injector 10 is provided for the single cylinder intake system, the invention is not limited thereto. That is, for example, the present invention may be applied also to a twin-injector type fuel injection system 36 shown in FIG. 5 in which the fuel injection system 36 is located on the upstream side as observed from the throttle valve 8, and an injector 38 is further provided to perform fuel injection at high engine speed and under high load. In this case, the injector 10 according to the present invention is responsible for fuel injection at low engine speed and under low load.

Thus,in the fuel injection system of the present invention of an internal combustion engine, the atomization of fuel can be promoted, thereby preventing fuel from flowing along the wall surface of the passage or from stagnating in a throttle body. In addition, the residual hydrocarbon in an exhaust gas can be reduced.

What is claimed is:

1. A fuel injection system of an internal combustion engine, comprising:

a throttle body of a cylindrical structure having a passage for supplying a fuel-air mixture to a combustion chamber of an engine;

a disc-shaped throttle valve disposed in the passage to be rotatable so as to regulate an amount of air flowing through the passage; and an injector means mounted on a peripheral wall of the passage and adapted to inject fuel in the passage at a portion of a downstream side of the throttle valve with respect to an air flow in the passage, wherein said throttle valve is provided with a through hole opened to both surfaces of the throttle valve, said through hole being formed at a portion on an injector location side with respect to a rotational axis of the throttle valve so that when said throttle body is closed, or nearly closed, an axis of the through hole substantially intersects a central axis of a fuel injected from the injector when observed from an upstream side of said throttle valve, on the injector location side, and wherein said throttle valve is disposed in the passage in an inclined manner in a fully closed condition thereof so that one end portion of the throttle valve on the injector location side is positioned on a downstream side of the rotational axis thereof and another end portion of the throttle valve is positioned on an upstream side of the rotational axis.

2. A fuel injection system according to claim 1, wherein said throttle valve is disposed in the passage in an inclined manner in a fully closed condition thereof so that one end portion of the throttle valve on the injector location side is positioned on a downstream side of the rotational axis thereof and another end portion of the throttle valve is positioned on an upstream side of the rotational axis.

3. A fuel injection system according to claim 2, wherein said one and another end portions of the throttle valves have end faces obliquely cut so as to extend along an inner wall surface of the throttle body forming the passage.

4. A fuel injection system according to claim 1, wherein said through hole is formed so as to extend vertically with respect to a thickness direction of the throttle valve.

5. A fuel injection system according to claim 1, wherein another injector means is mounted on the peripheral wall of the passage and adapted to inject fuel in the passage at a portion of an upstream side of the throttle valve with respect to an air flow in the passage.

6. A fuel injection system of an internal combustion engine comprising:

an approximately cylindrical throttle body having a passage for supplying a fuel-air mixture to a combustion chamber of an engine;

an approximately disc-shaped throttle valve rotatably disposed in the passage so as to regulate an amount of air flowing through the passage; and an injector mounted on a peripheral wall of the passage and structurally adapted to inject fuel in the passage at a portion of a downstream side of the throttle valve with respect to an air flow in the passage, wherein said throttle valve defines a through hole opened to both surfaces of the throttle valve, said through hole being formed at a portion on an injector location side with respect to a rotational axis of the throttle valve so that when said throttle body is closed, or nearly closed, an axis of the through hole substantially intersects a central axis of a fuel injected from the injector, and wherein said throttle valve is disposed in the passage in an inclined manner in a fully closed condition thereof so that one end portion of the throttle valve on the injector location side is positioned on a downstream side of the rotational axis thereof and another end portion of the throttle valve is positioned on an upstream side of the rotational axis.

7. A fuel injection system according to claim 6, wherein said one and another end portions of the throttle valves have end faces obliquely cut so as to extend along an inner wall surface of the throttle body forming the passage.

8. A fuel injection system according to claim 6, wherein said through hole is formed so as to extend vertically with respect to a thickness direction of the throttle valve.

9. A fuel injection system according to claim 6, wherein another injector is mounted on the peripheral wall of the passage and structurally adapted to inject fuel in the passage at a portion of an upstream side of the throttle valve with respect to an air flow in the passage.

10. A fuel injection system according to claim 6, wherein said system includes a plurality of cylinders each provided with the throttle body and the injector, a delivery pipe supplying fuel to each of said injectors.

11. A fuel injection system according to claim 1, wherein said through hole has a diameter between about 0.5 mm and about 1.0 mm.

12. A fuel injection system according to claim 6, wherein said through hole has a diameter between about 0.5 mm and about 1.0 mm.

13. A fuel injection system according to claim 6, wherein said axis of the through hole lies in a vertical plane that also contains said central axis of the fuel injected by said injector.

14. A fuel injection system according to claim 6, wherein the distance between said through hole and a surface nearest to said through hole is less than or equal to about one quarter of a diameter of said throttle valve.

15. A fuel injection system according to claim 1, wherein the distance between a surface of said throttle body closest to said central axis of said injected fuel is less than or equal to about 30 mm at idling conditions.

* * * * *